252-104 AU 166 EX
1/17/84 XR 4,426,203

United States Patent [19]
Abel et al.
[11] 4,426,203
[45] Jan. 17, 1984

[54] STABLE ANHYDROUS TEXTILE ASSISTANT

[75] Inventors: Heinz Abel; Josef Oxè, both of Reinach, Switzerland

[73] Assignee: Ciba-Geigy Corporation, Ardsley, N.Y.

[21] Appl. No.: 335,939

[22] Filed: Dec. 30, 1981

[30] Foreign Application Priority Data

Jan. 6, 1981 [CH] Switzerland ..... 32/81

[51] Int. Cl.³ ..... D06L 3/02; D06L 1/14
[52] U.S. Cl. ..... 8/138; 252/95; 252/99; 252/102; 252/104; 252/174.15
[58] Field of Search ..... 8/138; 252/95, 99, 102, 252/104, 174.15

[56] References Cited

U.S. PATENT DOCUMENTS

| | | | |
|---|---|---|---|
| 2,253,368 | 8/1941 | Dubeau | 252/95 |
| 2,834,748 | 5/1958 | Bailey et al. | 252/49.6 |
| 3,389,160 | 6/1968 | Reid | 528/31 |
| 3,505,377 | 4/1970 | Morehouse | 524/730 |
| 3,562,786 | 2/1971 | Bailey et al. | 252/174.15 |
| 3,850,831 | 11/1974 | Hellsten et al. | 252/104 |
| 4,071,468 | 1/1978 | Abel et al. | 252/321 |
| 4,092,266 | 5/1978 | Abel et al. | 252/321 |
| 4,309,298 | 1/1982 | Adrian et al. | 252/95 |
| 4,365,967 | 12/1982 | Guth et al. | 8/477 |

FOREIGN PATENT DOCUMENTS

| | | | |
|---|---|---|---|
| 47-25832 | 7/1972 | Japan | 8/138 |
| 1034782 | 6/1966 | United Kingdom | 252/174.15 |

*Primary Examiner*—Maria Parrish Tungol
*Attorney, Agent, or Firm*—Edward McC. Roberts

[57] ABSTRACT

The invention relates to a stable anhydrous textile assistant which comprises at least
(A) an anionic surfactant,
(B) an inorganic oxidizing agent,
(C) a siloxane-oxyalkylene copolymer and, optionally,
(D) a compound which combines with metal ions to form water-soluble colorless complexes, and/or
(E) a polar organic solvent.

The anionic surfactant (A) can also be combined with a non-ionic surfactant. The assistant mixture is used in particular for desizing cellulosic fibre materials by oxidation, preferably in combination with a bleaching process.

29 Claims, No Drawings

STABLE ANHYDROUS TEXTILE ASSISTANT

The present invention relates to a novel textile assistant and to the use thereof for desizing cellulosic materials.

It is an object of the present invention to provide a stable assistant which is suitable for removing size from cellulosic materials and blends thereof with synthetic fibres, which additionally has good wetting properties, and which can be readily used in aqueous disizing liquors, i.e. it neither causes the oxidising agent to decompose nor gives rise to troublesome foaming.

This object is accomplished with a stable anhydrous textile assistant which comprises at least (A) an anionic surfactant, (B) an inorganic oxidising agent, and (C) a siloxane-oxyalkylene copolymer.

In addition to the above components (A), (B) and (C), the assistant mixture of this invention may also contain, as component (D), a compound which combines with metal ions to form water-soluble colourless complexes, and, as component (E), a polar organic solvent.

Components (A), (B), (C), (D) and (E) may be in the form of individual compounds or mixtures.

Preferred mixtures contain all the above components (A), (B), (C), (D) and (E). The anionic surfactant employed as component (A) may also be used together in combination with a non-ionic surfactant.

The anionic surfactants (A) are preferably derivatives of alkylene oxide adducts, e.g. adducts of alkylene oxides, preferably of ethylene oxide and/or propylene oxide and also styrene oxide, with organic hydroxyl, carboxyl, amino and/or amido compounds containing aliphatic hydrocarbon radicals having a total of at least 4 carbon atoms, or mixtures of such compounds, which adducts contain acid ether groups or, preferably, acid ester groups of inorganic or organic acids. These acid ethers or esters can be in the form of the free acids or salts, e.g. alkali metal salts, alkaline earth metal salts, ammonium or amine salts.

These anionic surfactants are obtained by known methods, by addition of at least 1 mole, preferably of more than 1 mole, e.g. 2 to 60 moles, of ethylene oxide or propylene oxide, or alternately, in any order, ethylene oxide and propylene oxide, to the above organic compounds, and subsequently etherifying or esterifying the adducts, and, if desired, converting the ethers or esters into their salts. Suitable starting materials are e.g. higher fatty alcohols, i.e. alkanols or alkenols, each containing 8 to 22 carbon atoms, dihydric to hexahydric aliphatic alcohols containing 2 to 9 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, especially fatty amines containing such radicals, hydroxyalkylamines, hydroxyalkylamides and aminoalkyl esters of fatty acids or dicarboxylic acids and higher alkylated aryloxycarboxylic acids.

Examples of suitable anionic surfactants are:

sulfated aliphatic alcohols which contain 8 to 18 carbon atoms in the alkyl chain, e.g. sulfated lauryl alcohol;

sulfated unsaturated fatty acids or fatty acid lower alkyl esters which contain 8 to 20 carbon atoms in the fatty radical, e.g. ricinic acid and oils containing such fatty acids, e.g. castor oil;

alkylsulfonates containing 8 to 20 carbon atoms in the alkyl chain, e.g. dodecylsulfonate;

alkylarylsulfonates with linear or branched alkyl chain containing at least 6 carbon atoms, e.g. dodecylbenzenesulfonates or 3,7-diisobutylnaphthalenesulfonates;

sulfonates of polycarboxylic acid esters, e.g. dioctylsulfosuccinates or sulfosuccinamides;

the alkali metal salts, ammonium salts or amine salts of fatty acids containing 10 to 20 carbon atoms, e.g. rosin salts, classified as soaps;

esters of polyalcohols, especially mono- or diglycerides of fatty acids containing 12 to 18 carbon atoms, e.g. monoglycerides of lauric, stearic or oleic acid; and the adducts of 1 to 60 moles of ethylene oxide and/or propylene oxide with fatty amines, fatty acids or fatty alcohols, each containing 8 to 22 carbon atoms, with alkylphenols containing 4 to 16 carbon atoms in the alkyl chain, or with trihydric to hexahydric alkanols containing 3 to 6 carbon atoms, which adducts are converted into an acid ester with an organic dicarboxylic acid, e.g. maleic acid, malonic acid or sulfosuccinic acid, but preferably with an inorganic polybasic acid such as o-phosphoric acid or sulfuric acid.

Very suitable anionic surfactants (A) are (a) acid esters, or salts thereof, of a polyadduct of 2 to 30 moles of ethylene oxide with 1 mole of a fatty alcohol containing 8 to 22 carbon atoms, or with 1 mole of a phenol which contains at least one benzyl group, one phenyl group or preferably one alkyl group containing at least 4 carbon atoms, e.g. benzylphenol, dibenzylphenol, dibenzyl-(nonyl)phenol, o-phenylphenol, butylphenol, tributylphenol, octylphenol, nonylphenol, dodecylphenol or pentadecylphenol, and (b) sulfonated 1-benzylalkylbenzimidazoles containing 8 to 22 carbon atoms in the alkyl moiety. Components (a) and (b) may be used individually or in admixture.

Preferred components (A) have the formula $$R—O—(CH_2CH_2O)_mX, \quad (1)$$

wherein R is alkyl of 8 to 22 carbon atoms, alkylphenyl containing 4 to 16 carbon atoms in the alkyl moiety, or o-phenylphenyl, X is the acid radical of an inorganic oxygen-containing acid, e.g. sulfuric acid or, preferably, phosphoric acid, or is also the radical of an organic acid, and m is 2 to 30, preferably 2 to 15. The alkyl moiety of alkylphenyl is preferably in the para-position, and can be butyl, hexyl, n-octyl, n-nonyl, p-tert-octyl, p-isononyl, decyl or dodecyl. Preferred alkyl radicals are those containing 8 to 12 carbon atoms, with octyl and nonyl being most preferred. p The fatty alcohols for obtaining the anionic surfactants of the formula (1) are e.g. those containing 8 to 22, preferably 8 to 18, carbon atoms, such as octyl, decyl, lauryl, tridecyl, myristyl, cetyl, stearyl, oleyl, arachidyl or behenyl alcohol.

The acid radical X is derived, for example, from a low molecular dicarboxylic acid, e.g. from maleic acid, malonic acid, succinic acid or sulfosuccinic acid, and is linked to the oxyethylene part of the molecule through an ester bridge. In particular, X is derived from an inorganic polybasic acid such as orthophosphoric acid and, in particular, sulfuric acid. The acid radical X can be in salt form, i.e. for example in the form of an alkali metal salt, ammonium salt or amine salt. Examples of such salts are: lithium, sodium, potassium, ammonium, trimethylamine, ethanolamine, diethanolamine or triethanolamine salts.

Particularly preferred components (A) are anionic surfactants of the formula

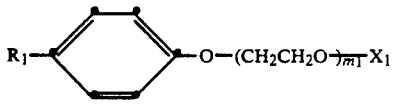

(2)

wherein $R_1$ is octyl or nonyl, $m_1$ is 2 to 15, and $X_1$ is derived from sulfuric acid or, preferably, from phosphoric acid, which surfactants are in the form of free acids or sodium or ammonium salts. A particularly preferred anionic surfactant is the acid phosphoric acid ester of the adduct of 5 to 12 moles of ethylene oxide with 1 mole of p-nonylphenol.

The anionic surfactants (A) may be used by themselves, as mixtures with one another, or also in combination with a non-ionic surfactant.

The non-ionic surfactant is advantageously a non-ionic adduct of 1 to 100 moles of alkylene oxide, e.g. ethylene oxide or propylene oxide, and 1 mole of an aliphatic monoalcohol containing at least 4 carbon atoms, of a trihydric to hexahydric aliphatic alcohol, of an unsubstituted or alkyl- or phenyl-substituted phenol, or of a fatty acid containing 8 to 22 carbon atoms.

The aliphatic monoalcohols employed for obtaining the non-ionic surfactants are e.g. water-insoluble monoalcohols containing at least 4, preferably 8 to 22, carbon atoms. These alcohols can be saturated or unsaturated and branched or straight-chain, and they can be employed individually or in admixture. It is possible to react natural alcohols, e.g. myristyl alcohol, cetyl alcohol, stearyl alcohol or oleyl alcohol, or synthetic alcohols such as, in particular, 2-ethylhexanol, and also trimethylhexanol, trimethylnonyl alcohol, hexadecyl alcohol or alfols, with the alkylene oxide.

Further aliphatic alcohols which can be reacted with alkylene oxide are trihydric to hexahydric alkanols. These contain 3 to 6 carbon atoms and are, in particular, glycerol, trimethylolpropane, erythritol, mannitol, pentaerythritol and sorbitol. The trihydric to hexahydric alcohols are preferably reacted with propylene oxide or ethylene oxide or with mixtures thereof.

Examples of suitable unsubstituted or substituted phenols are phenol, o-phenylphenol or alkylphenols containing 1 to 16, preferably 4 to 12, carbon atoms, in the alkyl moiety. Examples of these alkylphenols are: p-cresol, butylphenol, tributylphenol, octylphenol and, in particular, nonylphenol.

The fatty acids contain preferably 8 to 12 carbon atoms and may be saturated or unsaturated, e.g. capric, lauric, myristic, palmitic or stearic acid, and decenoic, dodecenoic, tetradecenoic, hexadecenoic, oleic, linoleic, linolenic or, preferably, ricinolic acid.

Representative examples of non-ionic surfactants are:

polyadducts of preferably 1 to 30 moles of alkylene oxides, especially ethylene oxide, individual ethylene oxide units of which can be replaced by substituted epoxides such as styrene oxide and/or propylene oxide, with higher unsaturated or saturated fatty alcohols, fatty acids, fatty amines or fatty amides containing 8 to 22 carbon atoms, or with phenylphenol or alkylphenols, the alkyl moieties of which contain at least 4 carbon atoms;

alkylene oxide condensation products, especially ethylene oxide and/or propylene oxide condensation products;

reaction products of a fatty acid containing 8 to 22 carbon atoms and a primary or secondary amine which contains at least one hydroxy-lower alkyl or lower alkoxy-lower alkyl group, or alkylene oxide adducts of these hydroxyalkylated reaction products, the reaction being conducted such that the molecular ratio of hydroxyalkylamine to fatty acid can be 1:1 and greater than 1, e.g. 1.1:1 to 2:1; and polyadducts of propylene oxide with a trihydric to hexahydric aliphatic alcohol containing 3 to 6 carbon atoms, e.g. glycerol or pentaerythritol, said polypropylene oxide adducts having an average molecular weight of 250 to 1800, preferably 400 to 900.

Very suitable non-ionic surfactants are polyadducts of 2 to 15 moles of ethylene oxide and 1 mole of a fatty alcohol or fatty acid, each containing 8 to 22 carbon atoms, or 1 mole of an alkylphenol containing a total of 4 to 12 carbon atoms in the alkyl moiety; or fatty acid dialkanolamine containing 8 to 22 carbon atoms in the fatty acid moiety.

Inorganic oxidising agents suitable for use as component (B) can be chlorates, iodates, chlorites, bromites, nitrites and, in particular, peroxide compounds. Examples of such oxidising agents are hydrogen peroxide, alkali metal peroxides, alkali metal perborates, alkali metal percarbonates, alkali metal persulfates, alkali metal persilicates, alkali metal perphosphates, ammonium persulfate, alkali metal chlorites, alkali metal bromites, alkali metal nitrites, alkali metal iodates, and alkali metal hypochlorites, in which compounds the alkali metal is preferably sodium or potassium. The most preferred oxidising agent is sodium persulfate ($Na_2S_2O_8$/sodium peroxide disulfate).

The siloxane-oxyalkylene copolymers used as component (C) are polyether siloxanes which advantageously have a cloud point in the range from about 20°–70° C., preferably from 25°–50° C. The glycol content consisting of oxyethylene groups or oxyethylene and oxypropylene groups is advantageously from 35 to 85% by weight, preferably from 40 to 75% by weight, based on the total weight of the polyether siloxane. The siloxane-oxyalkylene copolymers suitable for use as component (C) may be obtained e.g. from halogen-substituted organopolysiloxanes and alkali metal salts of polyoxyalkylene, e.g. polyethylene and/or polypropylene glycols.

Such polyether siloxanes may be illustrated by the formula

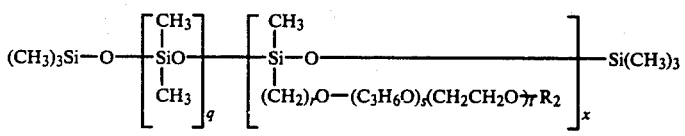

(3)

wherein q is 3 to 50, preferably 3 to 25, r is 2 or 3, s is 0 to 15, t is 1 to 25, x is 3 to 10 and $R_2$ is alkyl of 1 to 4 carbon atoms, preferably methyl.

Such polyether siloxanes are described e.g. in German Auslegeschrift No. 1 719 328 and in U.S. Pat. Nos. 2,834,748; 3,389,160 and 3,505,377.

Further polyether siloxanes which may be used as component (C) have the formula

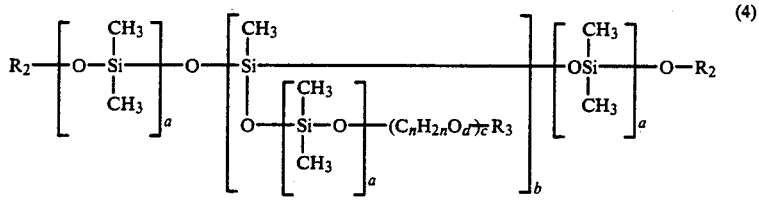

(4)

wherein each of $R_2$ and $R_3$ is alkyl of 1 to 4 carbon atoms, preferably methyl, a is 1 to 20, b is 2 to 20, c is 2 to 50, d is 1 or 2 and m is 2 to 5. Such siloxanes are described in German Auslegeschrift No. 1 795 557.

Preferred textile assistants contain at least the following components:

(Aa) an acid ester, preferably a phosphoric acid ester, or a salt thereof, of a polyadduct of 2 to 20 moles of ethylene oxide with 1 mole of a fatty alcohol containing 8 to 18 carbon atoms, or with 1 mole of a p-alkylphenol containing 4 to 16 carbon atoms in the alkyl moiety, or a mixture of these acid esters, (Bb) a peroxide compound, preferably sodium persulfate, and (Cc) a siloxane-oxyalkylene copolymer having a cloud point in the range from 25° to 50° C.

In addition to containing components (A), (B) and (C), the textile assistant of this invention can also contain, as component (D), a compound which combines with metal ions to form water-soluble colourless complexes. Suitable chelate-forming compounds of this kind are inorganic complex-forming compounds such as water-soluble polyphosphates or polymetaphosphates and preferably their alkali metal salts and magnesium salts, but preferably organic complex-forming compounds and, most preferably, basic nitrogen compounds which contain at least two nitrogen-bonded phosphonatomethyl or carboxymethyl groups which may be further substituted. These preferred nitrogen compounds are, in particular, aminoalkyleneacetic acids, aminocycloalkyleneacetic acids and aminoalkylenephosphonic acids, N-sulfoalkaneaminophosphonic acids, e.g. nitrilotriacetic acid, ethylenediaminetetraacetic acid, p-hydroxyethylethylenediaminetriacetic acid, cyclohexylenediaminetetraacetic acid, diethylenetriaminepentaacetic acid and nitrilo-tris(methylenephosphonic acid), 1-aminoethane-1,1-diphosphonic acid, N-sulfoethane-1-aminoethane-1,1-diphosphonic acid, 1-hydroxy-3-aminopropane-1,1-diphosphonic acid, ethylenediaminetetra(methylenephosphonic acid), diethylenetriaminepenta(methylenephosphonic acid), hexamethylenediaminetetra(methylenephosphonic acid) and the water-soluble salts, e.g. sodium or magnesium salts, of these acids.

Further organic complexing agents are e.g. hydroxylated polycarboxylic acids such as citric acid or gluconic acid, as well as water-soluble homopolymers of acrylic acid or maleic acid, preferably polymaleic anhydride, and also copolymers of acrylic acid with methacrylic acid, methacrylonitrile, acrylates, methacrylates and copolymers of maleic acid and styrene, maleic acid and a vinyl ester, or maleic acid and a vinyl ether, and preferably their water-soluble or alkali metal salts or ammonium salts. The preferred compound which combines with metal ions to form water-soluble colourless complexes is ethylenediaminetetraacetic acid and the water-soluble salts thereof, for example the alkali metal salts thereof, especially the disodium, trisodium and/or tetrasodium salt.

In addition, the textile assistants of this invention may contain, as polar solvent (E), a water-miscible organic solvent. The addition of solvent improves the solubility of the composition. Examples of water-miscible organic solvents are aliphatic $C_1$–$C_4$ alcohols such as methanol, ethanol or the propanols; alkylene glycols such as ethylene glycol or propylene glycol; monoalkyl ethers of glycols such as ethylene glycol monomethyl, monoethyl or monobutyl ether, and diethylene glycol monomethyl or monoethyl ether; ketones such as acetone, methyl ethyl ketone, cyclohexanone or diacetone alcohol; ethers and acetals such as diisopropyl ether, diphenyl oxide, dioxane, tetrahydrofurane, and also tetrahydrofurfuryl alcohol, pyridine, acetonitrile, γ-butyrolactone, N-methylpyrrolidone, N,N-dimethyl formamide, N,N-dimethyl acetamide, tetramethyl urea, tetramethylene sulfone etc. Mixtures of these solvents may also be used. The preferred solvent is propylene glycol.

The novel assistant mixtures can be prepared by simple stirring of the components (A), (B), (C) and, optionally, (D) and/or (E). However, the preferred method of preparing the novel assisant mixtures comprises grinding the oxidising agent (B), e.g. a persulfate, and component (A) (anionic surfactant or combination of an anionic and non-ionic surfactant), advantageously in a conventional mill for wet grinding, e.g. in a ball mill, bead mill, vibrating mill or sand mill, and adding the other components (C) and, optionally, (D) and (E) and any further ingredients, during or also after the grinding procedure, to give a stable anhydrous preparation which contains no sedimentation at all and no serum on the surface. In addition, the preparation is easy to handle, as it has good flow properties and is readily soluble in aqueous liquors.

The assistant mixture of this invention advantageously contains 5 to 60% by weight of component (A),
10 to 80% by weight of component (B),
0.5 to 10% by weight of component (C),
0 to 50% by weight, preferably 5 to 25% by weight, of component (D), and
0 to 50% by weight, preferably 10 to 40% by weight, of component (E).

in each case based on the weight of the total mixture.

The novel assistant mixtures are stable liquid formulations which are suitable in particular for desizing cellulosic fabrics. They can simultaneously have wetting and complexing properties, so that they can also be used as complexing agents for binding impurities or natural constituents, e.g. calcium and magnesium salts, in cellulosic material, especially in natural cotton.

Accordingly, it is a further object of the invention to provide a process for desizing cellulosic fibre materials by oxidation. The process comprises treating these fabrics in the presence of the textile assistant of this invention and in aqueous alkaline medium.

The amounts in which the assistant mixture of the invention is added to the treatment liquor vary from 2 to 30 g/l, preferably from 5 to 20 g/l.

The desizing liquor may contain further ingredients, e.g. soaps, fat dissolving agents, magnesium chloride, and especially alkalies. The preferred alkali is sodium hydroxide, which is used to maintain a pH value of 8 to 10. Further alkali metal hydroxides, such as potassium hydroxide, as well as ammonia or alkali metal salts, e.g. sodium carbonate or sodium bicarbonate, may also be used.

Suitable cellulosic material is, in particular, untreated natural cellulose, e.g. hemp, linen, jute, viscose rayon, viscose staple fibre, acetate rayon, natural cellulose fibres and, preferably, untreated cotton, as well as fibre blends, e.g. blends of polyacrylonitrile/cotton or polyester/cotton. The cellulosic material may be in the most diverse states of processing, e.g. loose material, yarn, wovens or knits.

The aqueous treatment liquors can be applied in known manner to the fibre materials, advantageously by impregnating them on a padder. The liquor pick-up is about 50 to 120% by weight. Suitable padding methods are, in particular, the pad-steam process and the pad-thermofix process.

Impregnation can be effected in the temperature range from 20° to 60° C., but preferably at room temperature. After it has been impregnated and squeezed out, the cellulosic material, if desired after an intermediate drying, is subjected to a heat treatment, e.g. in the temperature range from 95° to 210° C. For example, the heat treatment can be carried out after an intermediate drying at 80° to 120° C., by thermofixation at a temperature in the range from 120° to 210° C., preferably 140° to 180° C. It is preferred to carry out the heat treatment direct, i.e. without an intermediate drying, by steaming at 95° to 120° C., preferably 100° to 106° C. Depending on the nature of the heat development and the temperature range, the treatment can last from 30 seconds to 10 minutes. If desired, the impregnated and squeezed cellulosic material can be rolled up before the heat treatment, packed in a plastic sheet, and stored for 1 to 24 hours at room temperature. Immediately after the heat treatment, the desized cellulosic material can be given a washing-off and passed through an acid bath, e.g. an acetic acid bath.

The desizing process of the invention is conveniently combined with a bleaching process, which can be carried out before, during or after the desizing process. It is preferred to carry out the combined bleaching during or after the desizing of the textile material. In the last-mentioned case, the substrate is treated, after the desizing process, with an aqueous liquor which contains water glass (sodium silicate), alkali hydroxides and peroxides, and is again subjected to a heat treatment or to a cold pad-batch process.

Instead of the peroxide bleach, a bleaching with alkali hypochlorites, e.g. sodium hypochlorite or sodium chlorite, can be effected. If a cold pad-batch process is employed, e.g. a peroxide cold pad-batch bleaching, the textile material is impregnated with a liquor which contains the assistant of the invention as well as water glass, alkali hydroxides, hydrogen peroxide and, if desired, magnesium chloride, and then stored cold for 16 to 24 hours and subsequently washed. The bleaching of the textile material can be carried out during the desizing process while simultaneously using the assistant of the invention and the above bleaching ingredients. It is preferred to carry out the simultaneous desizing and bleaching of the textile material in one single step using the assistant of the invention, the above bleaching ingredients and a further aqueous preparation which, in addition to magnesium chloride, contains non-ionic surfactants or a mixture of non-ionic and anionic surfactants. The anionic and non-ionic surfactants employed can be the same compounds referred to at the outset, individually or in combination. Preferred surfactant combinations for the peroxide bleaching consist of alkylphenol oxethylates, fatty alcohol oxethylates and sulfonated 1-benzyl-2-alkylbenzimidazoles containing 8 to 22 carbon atoms in the alkyl moiety.

The cellulosic materials treated by the process of the invention are substantially free from sizing agents or residues thereof, such as natural starch, starch ethers, alginates, polyacrylic acid, polyvinyl alcohols, glue sizes or protein starches, and from natural accompanying substances such as alkaline earth compounds which can be in the form of deposits, and also from other impurities. The cellulosic material has a level appearance, has a pleasantly soft handle and good rewettability. The material has no tendency to become dusty. Further, no troublesome foaming occurs during the treatment of the cellulosic material in the presence of the assistant mixture of the invention.

In the following Examples percentages are by weight, unless otherwise indicated.

The following adducts are examples of component (A).

ANIONIC COMPONENTS (A)

$A_1$ the ammonium salt of the acid sulfuric acid ester of the adduct of 2 moles of ethylene oxide and 1 mole of alfol (1014);

$A_2$ the ammonium salt of the acid sulfuric acid ester of the adduct of 2 moles of ethylene oxide and 1 mole of stearyl alcohol;

$A_3$ the ammonium salt of the acid sulfuric acid ester of the adduct of 3 moles of ethylene oxide and 1 mole of 2-ethylhexanol;

$A_4$ the ammonium salt of the acid sulfuric acid ester of the adduct of 15 moles of ethylene oxide and 1 mole of stearyl alcohol;

$A_5$ the ammonium salt of the acid sulfuric acid ester of the adduct of 3 moles of ethylene oxide and 1 mole of tridecyl alcohol;

$A_6$ the ammonium salt of the acid sulfuric acid ester of the adduct of 4 moles of ethylene oxide and 1 mole of hydroabietyl alcohol;

$A_7$ the ammonium salt of the acid sulfuric acid ester of the adduct of 3 moles of ethylene oxide and 1 mole of alfol (2022);

$A_8$ the ammonium salt of the acid sulfuric acid ester of the adduct of 3 moles of ethylene oxide and 1 mole of lauryl alcohol;

$A_9$ the di-($\beta$-hydroxyethyl)amine salt of the acid sulfuric acid ester of the adduct of 3 moles of ethylene oxide and 1 mole of lauryl alcohol;

$A_{10}$ the sodium salt of the acid sulfuric acid ester of the adduct of 2 moles of ethylene oxide and 1 mole of lauryl alcohol;

$A_{11}$ the sodium salt of the acid sulfuric acid ester of the adduct of 3 moles of ethylene oxide and 1 mole of lauryl alcohol;

$A_{12}$ the acid phosphoric acid ester of the adduct of 5 moles of ethylene oxide and 1 mole of 2-ethyl-n-hexanol;

$A_{13}$ the ammonium salt of the acid sulfuric acid ester of the adduct of 3 moles of ethylene oxide and 1 mole of butylphenol;

$A_{14}$ the ammonium salt of the acid sulfuric acid ester of the adduct of 5 moles of ethylene oxide and 1 mole of tributylphenol;

$A_{15}$ the ammonium salt of the acid sulfuric acid ester of the adduct of 2 moles of ethylene oxide and 1 mole of nonylphenol;

$A_{16}$ the ammonium salt of the acid sulfuric acid ester of the adduct of 10 moles of propylene oxide and 10 moles of ethylene oxide and 1 mole of nonylphenol;

$A_{17}$ the ammonium salt of the acid sulfuric acid ester of the adduct of 35 moles of ethylene oxide and 1 mole of nonylphenol;

$A_{18}$ the ammonium salt of the acid sulfuric acid ester of the adduct of 50 moles of ethylene oxide and 1 mole of nonylphenol;

$A_{19}$ the ammonium salt of the acid sulfuric acid ester of the adduct of 15 moles of propylene oxide and 1 mole of nonylphenol;

$A_{20}$ the ammonium salt of the acid sulfuric acid ester of the adduct of 6 moles of ethylene oxide and 1 mole of dodecylphenol;

$A_{21}$ the ammonium salt of the acid sulfuric acid ester of the adduct of 6 moles of ethylene oxide and 1 mole of pentadecylphenol;

$A_{22}$ the ammonium salt of the acid sulfuric acid ester of the adduct of 8 moles of ethylene oxide and 1 mole of o-phenylphenol;

$A_{23}$ the sodium salt of the acid maleic acid ester of the adduct of 2 moles of ethylene oxide and 1 mole of p-nonylphenol;

$A_{24}$ the sodium salt of the acid monosulfosuccinic acid ester of the adduct of 2 moles of ethylene oxide and 1 mole of p-nonylphenol;

$A_{25}$ the ammonium salt of the acid phosphoric acid ester of the adduct of 2 moles of ethylene oxide and 1 mole of nonylphenol;

$A_{26}$ the acid phosphoric acid ester of the adduct of 10 moles of ethylene oxide and 1 mole of p-nonylphenol;

$A_{27}$ the sodium salt of the acid sulfuric acid ester of the adduct of 15 moles of ethylene oxide and 1 mole of dibenzyl-(nonyl)-phenol;

$A_{28}$ the sodium salt of the acid sulfuric acid ester of the adduct of 12 moles of ethylene oxide and 1 mole of dibenzylphenol.

NON-IONIC COMPONENT (AN)

$AN_1$ the reaction product of 6 moles of ethylene oxide and 1 mole of 2-ethyl-hexanol;

$AN_2$ the reaction product of 5 moles of ethylene oxide and 1 mole of 2-ethyl-hexanol;

$AN_3$ the reaction product of 15 moles of ethylene oxide and 1 mole of stearyl alcohol;

$AN_4$ the reaction product of 4 moles of ethylene oxide and 1 mole of alfol (8–10);

$AN_5$ the reaction product of 5 moles of ethylene oxide and 1 mole of hexadecyl alcohol;

$AN_6$ the reaction product of 18 moles of ethylene oxide and 1 mole of oleyl alcohol;

$AN_7$ the reaction product of 6 moles of ethylene oxide and 2 moles of butylphenol;

$AN_8$ the reaction product of 6 moles of ethylene oxide and 2 moles of p-cresol;

$AN_9$ the reaction product of 6 moles of ethylene oxide and 1 mole of tributylphenol;

$AN_{10}$ the reaction product of 8 moles of ethylene oxide and 1 mole of octylphenol;

$AN_{11}$ the reaction product of 9 moles of ethylene oxide and 1 mole of nonylphenol;

$AN_{12}$ the reaction product of 6 moles of ethylene oxide and 1 mole of nonylphenol;

$AN_{13}$ the reaction product of 8 moles of ethylene oxide and 1 mole of nonylphenol;

$AN_{14}$ the reaction product of 15 moles of ethylene oxide and 1 mole of oleyl alcohol;

$AN_{15}$ the reaction product of 12 moles of ethylene oxide and 1 mole of oleic acid;

$AN_{16}$ the reaction product of 8 moles of ethylene oxide and 1 mole of o-phenylphenol;

$AN_{17}$ the reaction product of 5 moles of ethylene oxide and 5 moles of propylene oxide and 1 mole of alfol (12–14)

$AN_{18}$ block polymer consisting of 20% of ethylene oxide and 80% of propylene oxide and having a molecular weight of 4000 to 5000.

EXAMPLE 1

A raw cotton fabric is impregnated in a padder at room temperature with an aqueous liquor which contains 12 g/l of a preparation (1) consisting of 30% of component $A_{26}$
7% of component $A_{12}$
27% of ground sodium persulfate
2% of a siloxane-oxyalkylene copolymer having a cloud point of 32° C.
13% of the disodium salt of ethylenediaminetetraacetic acid and
40 g/l of sodium hydroxide.

The liquor pick-up is 100%. After it has been padded, the fabric is rolled up and stored for 2 hours at room temperature. The fabric is then steamed for 1 minute at 110° C. with saturated steam and washed at 98° C., 70° C. and finally cold, each wash lasting 1 minute. Finally, the goods are squeezed out and dried. A test shows that the fabric has been well desized and contains almost no starch residues.

EXAMPLE 2

A sized raw cotton fabric is impregnated in a continuous scouring unit for 1 minute with an aqueous liquor which contains 15 g/l of preparation (1) and 60 g/l of sodium hydroxide. After it has been impregnated, the fabric is steamed for 5 minutes at 100°–103° C. with saturated steam. The goods are then rinsed initially at boiling temperature and then washed cold and treated with acetic acid. Finally, the goods are squeezed out and dried. The treated fabric is free from size residues, seed husks and further impurities.

EXAMPLE 3

The procedure described in Example 2 is repeated, except that the 15 g/l of preparation (1) is replaced by the same amount of preparation (2) which consists of 20% of component $A_{26}$
7% of component $A_{12}$
10% of component $AN_4$ 27% of ground sodium persulfate
2% of a siloxane-oxyalkylene copolymer having a cloud point of 32° C.
13% of the disodium salt of ethylenediaminetetraacetic acid and
21% of 1,2-propylene glycol.

A fabric which is free from size residues and further impurities is likewise obtained.

EXAMPLE 4

A raw cotton fabric is impregnated in a padder to a pick-up of 100% with an aqueous liquor which contains 15 g/l of preparation (1) and 100 g/l of sodium hydroxide. The impregnated goods are then steamed for 1½ minutes at 100°-103° C. with saturated steam. The fabric is subsequently padded once more to a pick-up of 100% with an aqueous liquor which contains 3 ml/l of water glass (38° Bé), 5 g/l of sodium hydroxide and 40 mg/l of 35% hydrogen peroxide. The goods are then rinsed hot and cold, treated with acetic acid, squeezed out and dried, giving a fine bleached, clean fabric which is free from size residues.

EXAMPLE 5

A raw cotton fabric is impregnated in a padder at room temperature with an aqueous liquor which contains 10 g/l of preparation (1), 10 g/l of a combination consisting of 10% of component $AN_{11}$
28% of a fatty alcohol ethoxylate, e.g. component $AN_2$ or $AN_4$
7% of magnesium chloride
5% of sodium 1-benzyl-2-heptadecyl-benzimidazoledisulfonate
3% of fatty acid diethanolamide
9% of sulfated 2-ethyl-hexanol and
38% of water, and also 25 g/l of water glass (38° Bé), 10 g/l of sodium hydroxide and 40 g/l of 35% hydrogen peroxide. The liquor pick-up is 100%. After it has been padded, the fabric is rolled up and stored for 12 hours at room temperature. The fabric is then steamed for 2 minutes at 100°-103° C. with saturated steam and subsequently washed in a washing machine at 98° C., 70° C. and then cold, each wash lasting ½ to 1 minute. A test shows that the fabric is well desized and also has a high degree of whiteness and very good absorption properties.

EXAMPLE 6

A raw cotton fabric is impregnated in a padder at room temperature with an aqueous liquor which contains 5 g/l of preparation (1)
5 g/l of the combination of Example 5
25 g/l of sodium silicate (38° Bé)
25 g/l of sodium hydroxide and
8 g/l of 35% hydrogen peroxide.

The pick-up is 100%. After it has been rolled up and stored for 4 hours, the fabric is washed for 15 seconds at the boil, for 15 seconds at 70° C. and for 15 seconds cold and then mercerised in conventional manner. The fabric is then bleached by a cold pad-batch process. The goods are subsequently impregnated to a pick-up of 100% with a treatment liquor which contains 10 g/l of preparation (1)
10 g/l of the combination of Example 5
15 g/l of sodium silicate (38° Bé)
12 g/l of sodium hydroxide
50 g/l of 35% sodium peroxide.

After it has been stored for 24 hours at room temperature, the fabric is washed as described above. The treated fabric has a high degree of whiteness and very good rewettability.

What is claimed is:

1. A stable anhydrous textile assistant which comprises at least (A) an anionic surfactant of the formula $$R—O—(CH_2CH_2O)_mX$$

wherein R is alkyl or alkenyl of 8 to 22 carbon atoms, o-phenylphenyl or alkylphenyl containing 4 to 16 carbon atoms in the alkyl moiety, X is a phosphoric acid radical, and m is 2 to 30; (B) an inorganic oxidizing agent, and (C) a siloxane-oxyalkylene copolymer.

2. An assistant according to claim 1 which additionally comprises, as component (D), a compound which combines with metal ions to form water-soluble colourless complexes.

3. An assistant according to claim 1 which additionally comprises, as component (E), a polar organic solvent.

4. An assistant according to claim 3 which comprises components (A), (B), (C), (D) and (E).

5. An assistant according to claim 1, wherein the surfactant is in the form of the free acid, ammonium salt or alkali metal salt.

6. An assistant according to claim 5, R is octylphenyl or nonylphenyl and m is 2 to 15, said surfactant being in the form of the free acid or of the sodium or ammonium salt.

7. An assistant according to claim 1, wherein component (A) is a mixture of an anionic and a non-ionic surfactant.

8. An assistant according to claim 1, wherein the oxidising agent is an inorganic peroxide compound.

9. An assistant according to claim 8, wherein the oxidising agent is sodium persulfate.

10. An assistant according to claim 1, wherein component (C) is a polyether siloxane having a cloud point in the range from 20° to 70° C.

11. An assistant according to claim 10, wherein the polyether siloxane has a cloud point of 25° to 50° C.

12. An assistant according to claim 1 which comprises at least (Aa) a phosphoric acid ester, or salt thereof, of a polyadduct of 2 to 20 moles of ethylene oxide and 1 mole of a fatty alcohol containing 8 to 18 carbon atoms or 1 mole of a p-alkylphenol containing 4 to 16 carbon atoms in the alkyl moiety, or a mixture of said acid ester, (Bb) sodium persulfate, and (Cc) a siloxane-oxyalkylene copolymer having a cloud point in the range from 25° to 50° C.

13. An assistant according to claim 2, wherein component (D) is a basic nitrogen compound which contains at least two nitrogen-bonded phosphonatomethyl or carboxymethyl groups.

14. An assistant according to claim 13, wherein component (D) is ethylenediaminetetraacetic acid or a water-soluble salt thereof.

15. An assistant according to claim 3, wherein component (E) is propylene glycol.

16. An assistant according to claim 1, which comprises, based on the weight of the total mixture, 5 to 60% by weight of component (A)
10 to 80% by weight of component (B)
0.5 to 10% by weight of component (C)
0 to 50% by weight of component (D), and 0 to 50% by weight of component (E).

17. An assistant according to claim 16, wherein component (D) is present in an amount of the 10 to 25% by weight, based on the weight of the mixture.

18. An assistant according to claim 16, wherein component (E) is present in an amount of the 10 to 40% by weight, based on the weight of the mixture.

19. A process for desizing cellulosic, material which comprises treating said material, in aqueous alkaline medium, in the presence of an assistant which comprises at least (A) an anionic surfactant of the formula $$R—O—(CH_2CH_2O)_mX$$

wherein R is alkyl or alkenyl of 8 to 22 carbon atoms, o-phenylphenyl or alkylphenyl containing 4 to 16 carbon atoms in the alkyl moiety, X is a phosphoric acid radical, and m is 2 to 30; (B) an inorganic oxidizing agent, and (C) a siloxane-oxyalkylene copolymer.

20. A process according to claim 19, wherein the assistant additionally comprises (D) a compound which combines with metal ions to form a water-soluble colorless complex and (E) a polar organic solvent.

21. A process according to claim 19, wherein the treatment liquor contains the assistant in an amount of 2 to 30 g/l.

22. A process according to claim 19, which comprises applying the treatment liquor continuously to the cellulosic material, squeezing out said material, and then subjecting it to a steam treatment.

23. A process according to claim 19, comprising the additional step of bleaching the cellulosic material.

24. A process according to claim 23, wherein the bleaching step is carried out during or after the desizing step.

25. A process according to claim 24, wherein the bleaching step is carried out by means of a cold pad-batch treatment.

26. A process according to claim 23, wherein the bleaching step is carried out in the presence of hydrogen peroxide.

27. A process according to claim 23, wherein the bleaching step is carried out in the presence of magnesium chloride and a non-ionic surfactant, or magnesium chloride and a mixture of a non-ionic surfactant and an anionic surfactant.

28. A process according to claim 27, wherein the non-ionic surfactant is a polyadduct of 2 to 15 moles of ethylene oxide and 1 mole of a fatty alcohol of 8 to 22 carbon atoms or 1 mole of an alkylphenol having 4 to 12 carbon atoms in the alkyl moiety, or a mixture of said polyadducts.

29. A process according to claim 27, wherein the anionic surfactant is a sulfonated 1-benzyl-2-alkylbenzimidazole having 8 to 22 carbon atoms in the alkyl moiety.

* * * * *